US009297369B2

(12) United States Patent
Duerr et al.

(10) Patent No.: US 9,297,369 B2
(45) Date of Patent: Mar. 29, 2016

(54) HYDROSTATIC MACHINE HAVING A CONTROL DEVICE HAVING A RETURN ELEMENT FOR CONTROLLING A REGULATING VALVE

(75) Inventors: Michael Duerr, Horb (DE); Clemens Krebs, Tuebingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 851 days.

(21) Appl. No.: 12/672,292

(22) PCT Filed: Jul. 28, 2008

(86) PCT No.: PCT/EP2008/006195

§ 371 (c)(1),
(2), (4) Date: Feb. 18, 2010

(87) PCT Pub. No.: WO2009/018934

PCT Pub. Date: Feb. 12, 2009

(65) Prior Publication Data

US 2010/0202900 A1 Aug. 12, 2010

(30) Foreign Application Priority Data

Aug. 7, 2007 (DE) ..... 10 2007 037 104

(51) Int. Cl.

| | |
|---|---|
| ***F04B 1/32*** | (2006.01) |
| ***F03C 1/40*** | (2006.01) |
| ***F04B 1/30*** | (2006.01) |

(52) U.S. Cl.

CPC ..... *F04B 1/324* (2013.01); *F03C 1/0678* (2013.01); *F03C 1/0686* (2013.01); *F04B 1/30* (2013.01)

(58) Field of Classification Search

CPC ..... F04B 7/025; F04B 1/16; F04B 7/0053; F04B 13/00; F04B 1/184; F04B 1/324; F04B 2201/1205; F03C 1/0678; F03C 1/0686

USPC ..... 417/269, 222.1; 91/504, 505, 506; 92/12.2, 13

See application file for complete search history.

(56) References Cited

U.S. PATENT DOCUMENTS 3,463,087 A * 8/1969 Grant ..... 91/506
3,633,464 A * 1/1972 Aoyama et al. ..... 91/505

(Continued)

FOREIGN PATENT DOCUMENTS

DE 2 352 739 5/1974
DE 31 30 659 A1 2/1983

(Continued)

OTHER PUBLICATIONS

Notification of Reason(s) for Refusal dated Mar. 6, 2012 issued in Japanese Patent Application No. 2010-519359 (English language translation only).

*Primary Examiner* — Devon Kramer
*Assistant Examiner* — Kenneth J Hansen
(74) *Attorney, Agent, or Firm* — Scully Scott Murphy and Presser

(57) ABSTRACT

A hydrostatic machine having an actuating device for adjusting a displacement volume of the hydrostatic machine is provided. The actuating device has a return element for actuating a control valve as a function of a position of the actuating device. A valve unit is further provided for adjusting an actuating pressure of the actuating device, which is activated mechanically by means of the return element.

30 Claims, 7 Drawing Sheets

(56) References Cited

U.S. PATENT DOCUMENTS

| | | | | | |
|---|---|---|---|---|---|
| 4,483,663 | A | * | 11/1984 | Myers | 417/222.1 |
| 5,226,349 | A | * | 7/1993 | Alme et al. | 91/506 |
| 5,273,403 | A | * | 12/1993 | Im et al. | 417/213 |
| 5,297,941 | A | * | 3/1994 | Park | 417/218 |
| 5,486,097 | A | * | 1/1996 | Schaffner | 417/222.1 |
| 6,030,182 | A | | 2/2000 | Voigt | |
| 6,033,188 | A | * | 3/2000 | Baldus et al. | 417/222.1 |
| 6,095,760 | A | * | 8/2000 | Houtman | 417/222.2 |
| 2010/0199838 | A1 | * | 8/2010 | Krebs et al. | 91/505 |
| 2011/0277624 | A1 | * | 11/2011 | Nafz et al. | 91/358 R |

FOREIGN PATENT DOCUMENTS

| | | | |
|---|---|---|---|
| JP | H10-2279 | A | 1/1998 |
| JP | 2002-20206 | A | 7/2002 |

* cited by examiner

HYDROSTATIC MACHINE HAVING A CONTROL DEVICE HAVING A RETURN ELEMENT FOR CONTROLLING A REGULATING VALVE

BACKGROUND

The invention relates to a hydrostatic machine having a control device for adjusting the displacement volume of the hydrostatic machine, wherein the control device comprises a return element for controlling a regulating valve.

When adjusting displacement volumes of hydrostatic machines, e.g., axial piston machines, maximum and minimum displacement volumes can generally be adjusted by way of integrated control devices. These maximum and minimum displacement volumes are fixed within an axial piston machine by mechanical stops. The control of minimum or maximum volumes is thus associated with a control of minimum and/or maximum stop regions. The stressed stop regions have a considerable load placed thereon in the case of extremely quick pivoting actions which extend to the stressed mechanical stop regions. These loads result in signs of wear and material fatigue in the components of the control systems located in the flow of force.

The loading of the components of the mechanical limitation located in the flow of force could cause the components to become worn or to change such that the operation and thus quality of operation of the control devices—whose component parts also include the minimum or maximum stop regions—becomes impaired. For example, wear on a mechanical stop changes the displacement volume, wherein the movement of an adjusting mechanism is limited by the stop. A control pressure acting in the control device is adjusted by a regulating valve in dependence upon the position of the control device.

It is thus the object of the invention to provide a hydrostatic machine in which the hard stopping of components on the mechanical maximum and/or minimum stop regions is prevented and which thus comprises a displacement volume limitation which is not subject to wear.

SUMMARY

The axial piston machine in accordance with the invention comprises a control device for adjusting the displacement volume. The control device for adjusting the displacement volume comprises a return element and a regulating valve. The return element and the regulating valve co-operate to control a control pressure of the control device. The mechanical co-operation of the return element and the regulating valve adjusts a control pressure acting in the control device. In accordance with the invention, when a maximum or minimum displacement volume is reached, the control pressure is controlled such that hard stopping against a stop region is prevented. In this respect, an additional valve unit on the hydraulic path prevents further adjustment. When a particular position of the adjustment device is reached, the valve unit is actuated by the return element. The valve unit functions such that further adjustment of the control device in the same movement direction is counteracted.

It is advantageous to provide the control device with a first control piston which controls the axial piston machine towards the larger displacement volume and on which the return element is disposed. This return element effects a movement with a directional component along the first control piston axis. Thus, in a simple manner the positional and/or positional change information of the first control piston can be supplied mechanically by the return element to the regulating valve axial piston machine [sic].

By orienting a movement plane of the return element and a longitudinal axis of the additional valve unit at least approximately in a parallel manner with respect to each other, the mechanical co-operation of the return element and valve unit for controlling the control pressure of the control device is simplified on a technical level and is configured in a space-saving manner. By way of the preferred guiding of the return element in a groove of the housing of the axial piston machine, undesired directional components of the movement are prevented. Providing the return element with a control sleeve is advantageous in that within this control sleeve additional elements for exerting a pressure-dependent return force can be guided in a displaceable manner.

An arm is preferably formed on the control sleeve for actuating the valve unit. A force is mechanically applied to the valve unit by the arm of the control sleeve in order to control said unit. Providing the valve unit with a valve sleeve permits locking of the valve unit in an adjustable position by means of the positive-locking arrangement. This produces a simple way of adjusting the valve unit. An adjustable positive-locking arrangement for the valve sleeve is used to reliably and adjustably position the valve sleeve in relation to the housing in which it is received. By adjusting the position of the positive-locking arrangement, the valve sleeve can be adjusted in terms of its housing position such that the start of actuation of the valve unit is fixed.

The mode of action can advantageously be selected as hydraulic limitation of the minimum delivery volume $V_{gmin}$. In order to achieve the mode of action as hydraulic limitation of the minimum delivery volume $V_{gmin}$, a valve piston can be disposed in the valve sleeve in a displaceable manner and can be mechanically displaced by the application of force by the arm of the control sleeve of the return element. A radially tapered section is formed on the valve piston and forms an annular gap with the valve sleeve. The pressure medium can flow off via this annular gap towards the contact point between the arm of the control sleeve and the valve piston into a housing tank. A control pressure chamber of the control device is thus relieved and the function as hydraulic limitation of the minimum delivery volume $V_{gmin}$ or hydraulic zero dead stop is achieved.

BRIEF DESCRIPTION OF THE DRAWINGS

The invention is illustrated in the drawing and is explained in detail with the aid of the following description. In the drawing.

DETAILED DESCRIPTION OF EXEMPLARY EMBODIMENTS

Figure 1:
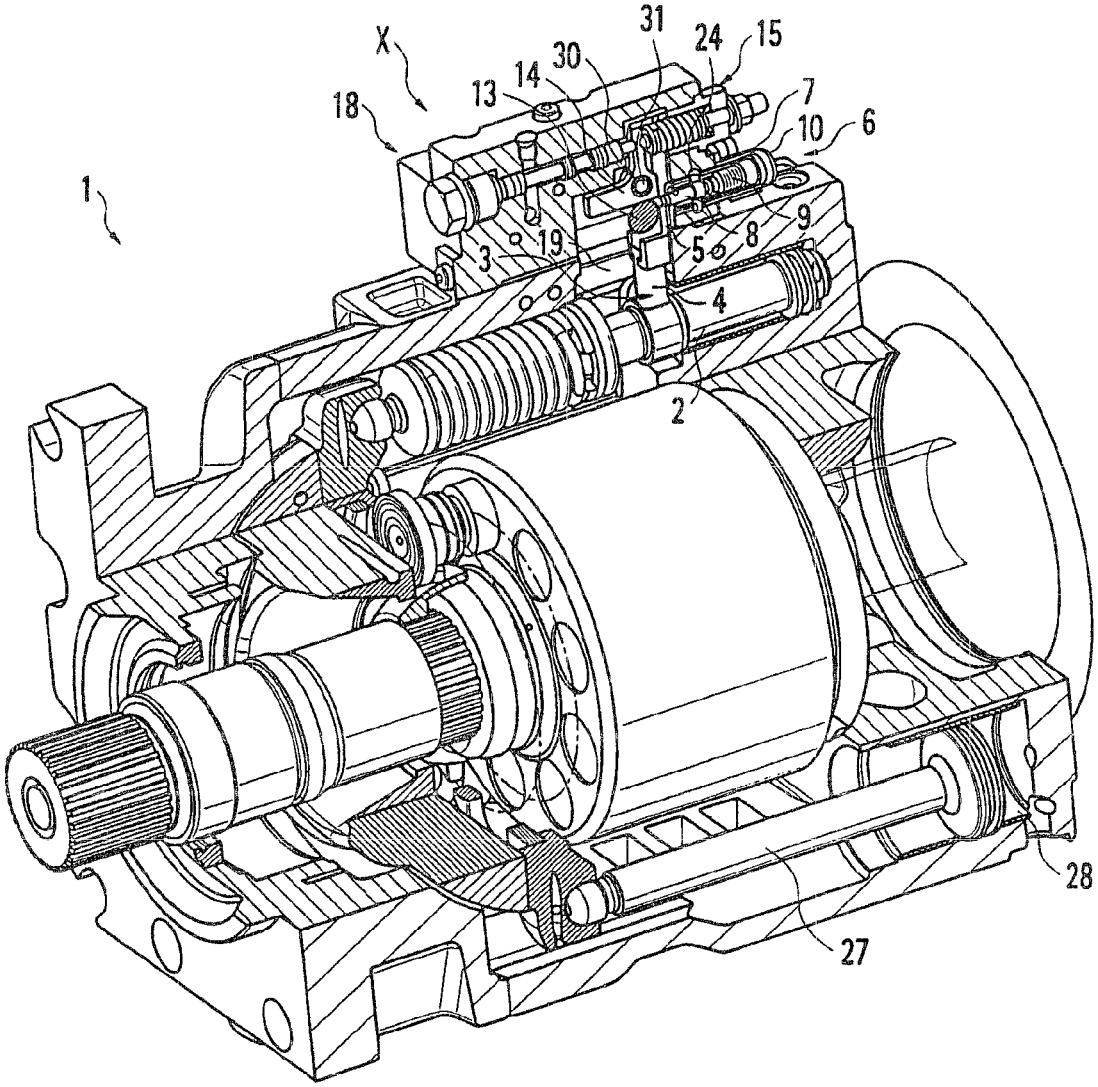
FIG. 1 shows a perspective illustration of a section of a first exemplified embodiment of an axial piston machine in accordance with the invention.

FIG. 1 shows a hydrostatic machine in accordance with the invention in the form of an axial piston machine 1 having a pivot-out piston 2 on which a return element 3 is disposed. The pivot-out piston 2 forms a first control piston of a control device and can be pressurised in a control pressure chamber by a control pressure in order to adjust the axial piston machine 1 towards the larger delivery volume. On a control sleeve 4 of the return element 3 there is formed an arm 5 of the control sleeve 4. The control sleeve 4 and the arm 5 of the control sleeve 4 are guided in a housing groove 19 along a valve axis of a valve unit, which is to be described hereinafter, and a pivot-out piston longitudinal axis.

The arm 5 is disposed laterally on the control sleeve 4 and extends in the longitudinal direction thereof. The control sleeve 4 is substantially perpendicular to the first control piston. The arm 5 of the control sleeve 4 is thus formed such that it can apply a force to a movable element of the valve unit 6 in order to co-operate therewith as hydraulic limitation e.g., of a minimum delivery volume $V_{gmin}$ of the axial piston machine 1. The valve unit 6 is disposed in a valve block 18 which is attached to the housing of the axial piston machine 1. The valve unit 6 comprises a valve sleeve 7 and a valve piston 8 which can be displaced therein along the valve axis. The valve piston 8 is influenced by a compression spring 9 towards a rest position, which compression spring is supported on a locking screw 10 at its opposite end.

At least one channel 24 is formed in the valve sleeve 7. The channel 24 connects the valve unit 6 to a second control pressure chamber 28 of the control device, which chamber is connected simultaneously (in parallel) to a regulating valve 15. A hydraulic force can be applied to a second control piston, which is formed as a pivot-in piston 27, by pressure acting in the second control pressure chamber 28. The pressure acting in the second control pressure chamber 28 can be adjusted via the regulating valve X. On the side of the arm 5 of the valve sleeve 4 remote from the valve unit 6, a roller 13 is mounted in a movable manner and applies, in a variable manner, a force dependent upon the delivery pressure of the axial piston machine 1 to a lever 14 of a hyperbola regulator in order to control the regulating valve 15. A force, which is proportional to the pressure which influences the control device in the first control pressure chamber towards the maximum delivery volume, is applied, in a variable manner, to the lever 14 of the hyperbola regulator by the roller 13 of the return element 3 at a commonly formed contact point. The position of the common contact point between the roller 13 and the lever 14 of the hyperbola regulator depends upon the position of the pivot-out piston along the pivot-out piston axis and thus upon the adjusted delivery volume. The lever 14 of the hyperbola regulator is part of an angled element 30 which is mounted in a rotational spindle 31 in a rotatable manner. The turning moment produced by the application of force at the contact point between the lever 14 and the roller 13 is proportional to the output of the axial piston machine 1 designed as an axial piston pump.

Figure 2:
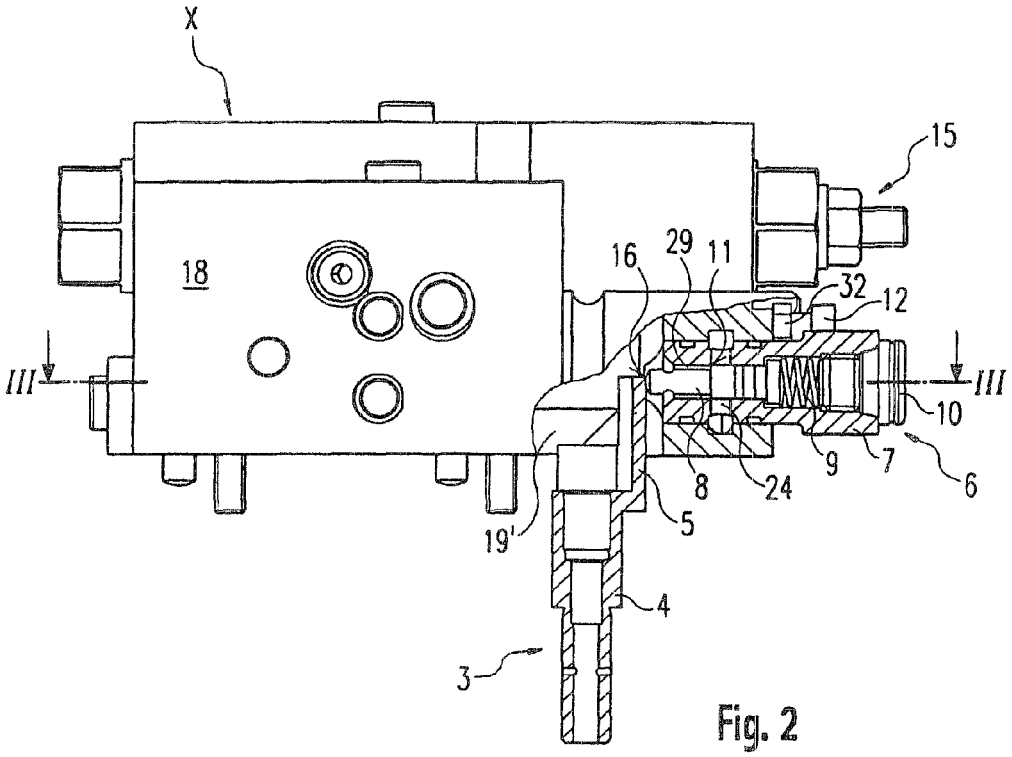
FIG. 2 shows a partial section of a regulating valve of the axial piston machine of FIG. 1.

FIG. 2 shows a side view of a partial section of a regulating valve X having a control sleeve 4 guided in a groove 19' of the valve block 18. The housing groove 19 and the groove 19' are formed such that they guide the return element 3 when the valve block 18 is assembled. The valve sleeve 7 is slid into the valve block 18 so as to be displaceable along the valve axis and is held in a desired position relative to the valve block 18 so as to be adjustable by means of a locking element 12. The valve piston 8 is disposed in the valve sleeve 7 so as to be displaceable along the valve axis and comprises a control edge 11. The channel 24 of the valve sleeve 7 is either connected to a chamber 29, which can be in the form of an annular gap, or is separated therefrom depending upon the position of the control edge 11 of the valve piston 8. The chamber 29 is connected to the housing tank/leak oil chamber. A connection, through which a flow can pass, between the channel 24 and the housing tank is thus created when the valve unit 6 is actuated. In contrast, in the rest position of the valve unit 6, which position is given by the compression spring 9, the connection is separated. The pressure in the second control pressure chamber 28, used to adjust the axial piston machine 1 towards the minimum delivery volume, is then adjusted solely by the regulating valve 15. The chamber of the compression spring 9 is connected to the housing tank by a longitudinal and transverse bore in the piston 8. Pressure equalisation in the chamber of the compression spring 9 is ensured when the piston 8 is moved.

On the side of the control edge 11 of the valve piston 8 remote from the locking screw 10, the chamber 29, in the form of an annular gap, is formed between the valve piston 8 and the valve sleeve 7, which gap is connected to the housing tank or a leak oil chamber. The opening of the valve sleeve 7 directed towards the valve block outer side is closed by the locking screw 10 which simultaneously forms a spring bearing for the compression spring 9. The arm 5 of the control sleeve 4 applies a force along the line III-III in FIG. 2 to the valve piston 8 via a contact point 16 on the end-side end of the valve piston 8 against the resistance of the compression spring 9 towards the locking screw 10. When the second control chamber 28 is pressurised via the regulating valve 15, the second control piston 27 is subjected to a force which exceeds the force of the first control piston 2. The second adjusting piston 27 moves to the left towards $Vg_{min}$ and, owing to the resulting movement of the pivot cradle, entrains the first adjusting piston 27 to the right. When the pivot-out piston 2 is adjusted to the right in FIG. 2 and thus the axial piston machine 1 formed as a hydraulic pump is adjusted towards the smaller delivery volume, the valve unit 6 is actuated by the arm 5 when a particular position $V_{gmin}$ is reached. The second control pressure chamber, which carries the control pressure which influences the pivot-in piston and which is required for the purposes of adjusting towards the minimum delivery volume, is relieved in the housing tank as a result. Excess force against the first adjusting piston 2 is then no longer applied and further pivoting back is prevented.

Figure 3:
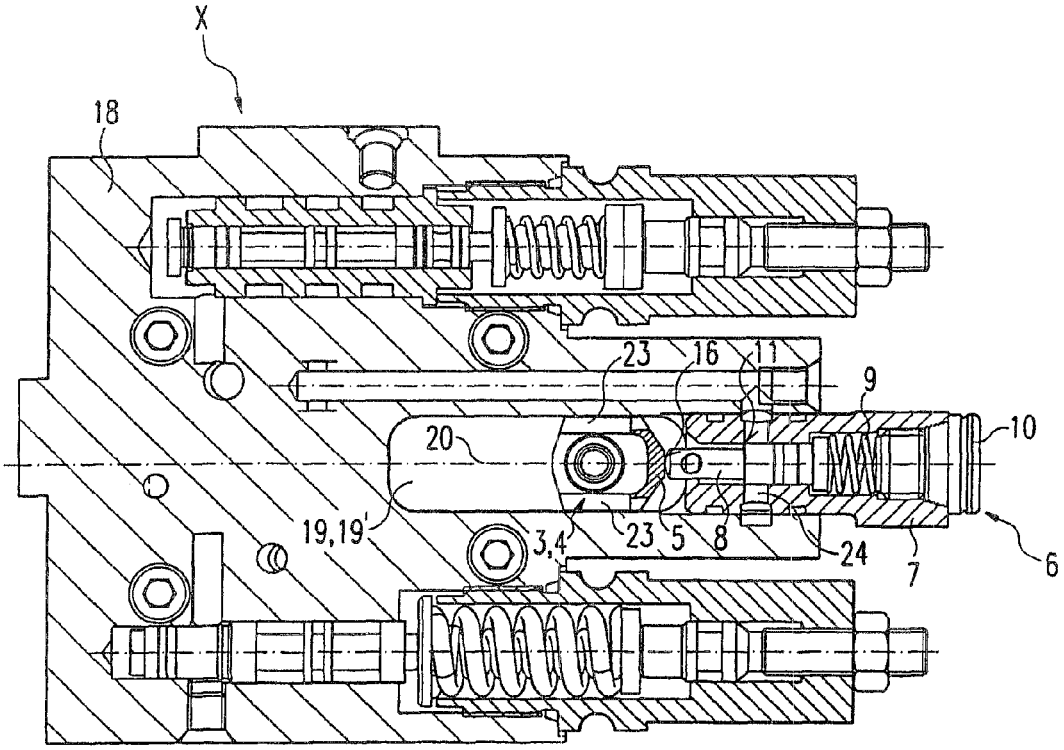
FIG. 3 shows a second partial section of the valve block of FIG. 1.

FIG. 3 illustrates, in a further partial section of the regulating valve X from FIG. 1, once again the arm 5 of the control sleeve 4, the valve sleeve 7, the channel 24, the valve piston 8, the compression spring 9, the locking screw 10, the control edge 11 and the contact point 16 between the arm 5 of the control sleeve 4 and the valve piston 8. The groove 19' corresponds to the housing groove 19 in terms of position and size and guides the control sleeve 4, either alone or together with the housing groove 19, along the valve axis 20 by means of the guide sections 23. In order to prevent jamming of the control sleeve 4, the groove 19 is designed to be wider. Guiding occurs only in one of the two grooves 19, 19'. Further valves which are disposed in the valve block 18 can additionally be seen in the sectional plane. Such valves can be e.g., pressure or delivery flow regulating valves of the regulating valve X for regulating the axial piston pump. In addition, a transverse bore can be seen on the end of the valve piston 8 oriented towards the return element 3. This transverse bore is connected to a relief bore incorporated in the valve piston 8 as a blind bore from the opposite end. Volume equalisation is thus possible in the chamber accommodating the compression spring 9 when the valve piston 8 is moved.

Figure 4:
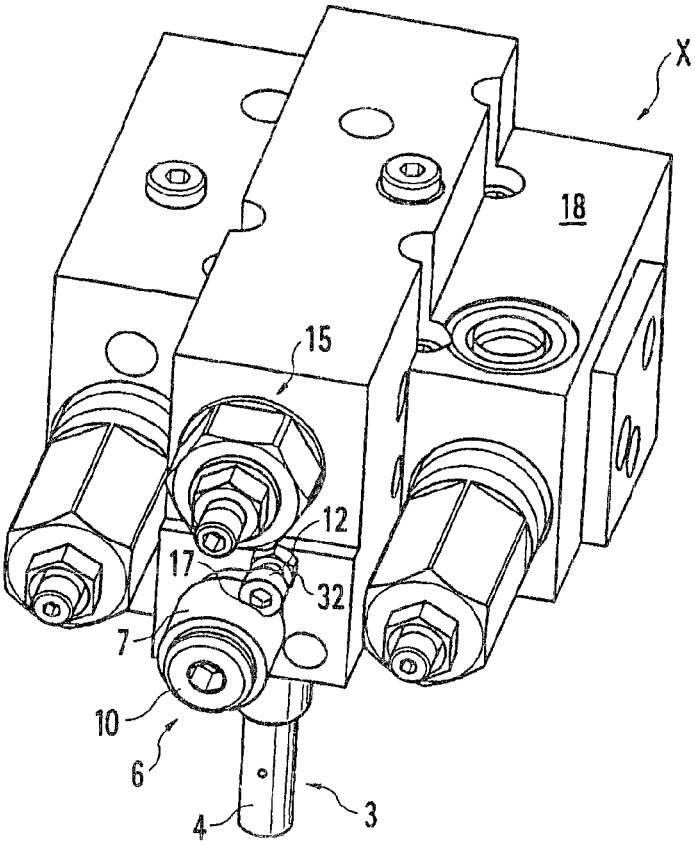
FIG. 4 shows a perspective illustration of the valve block of FIGS. 2 and 3.

FIG. 4 is a perspective view of the regulating valve X. The locking element 12, which is screwed into the valve block 18 to an adjustable depth, locks the valve sleeve 7 in a positive-locking manner in that a part of the locking element 12, e.g., a head of a socket head cap screw with minimum clearance, engages into a lateral recess 17 of the valve sleeve 7. The locking ensures that the valve sleeve 7 assumes a fixedly adjustable position relative to the valve block 18 and is not displaced axially along the valve sleeve 7 or rotated thereabout by any forces or turning moments which originate from operation for example. The locking element 12 is firmly fixed in its position in the valve block 18 using a counternut 32.

Figure 5:
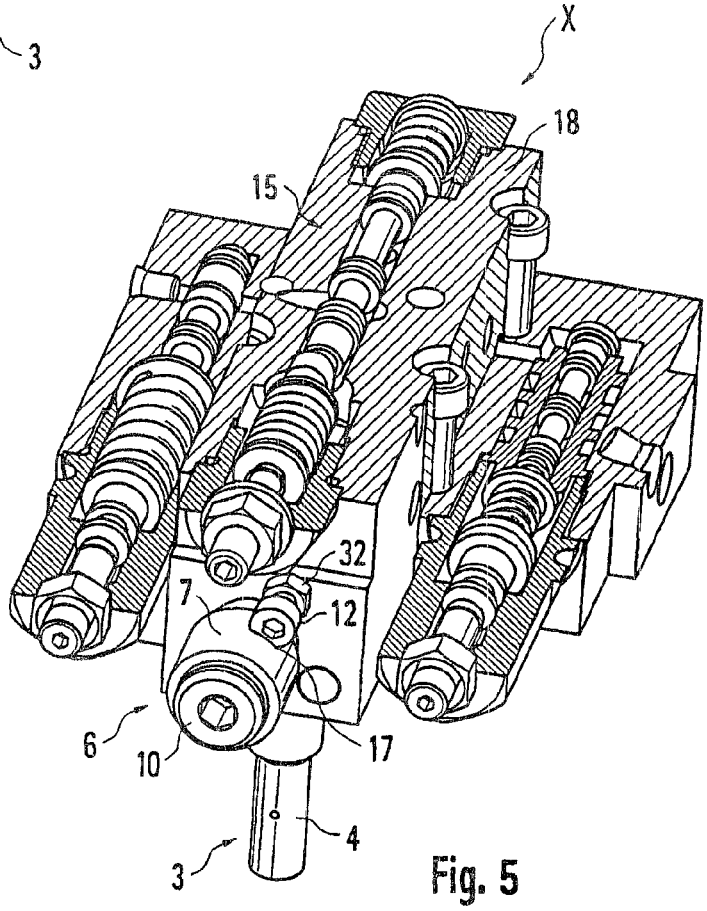
FIG. 5 shows a perspective illustration of a partial section of the valve block of FIGS. 2 and 3.

FIG. 5 shows a partial section of the perspective outer view of the regulating valve X of FIG. 4.

Figure 6:
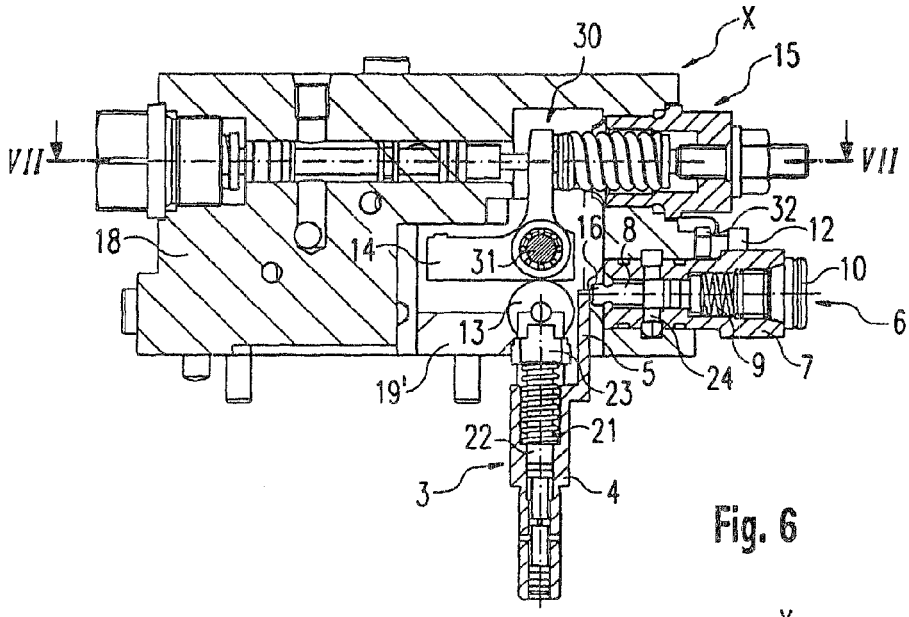
FIG. 6 shows a third section of the valve block of FIGS. 2 and 3.

FIG. 6 shows a section through the regulating valve X of FIG. 1. The co-operation of the return element 3 and the regulating valve 15 can also be seen in this Figure. The return element 3 guides a measuring piston 22 in its control sleeve 4, which piston is displaceable along the control sleeve longitudinal axis. A guide section 23 formed on the outside of the measuring piston 22 is used for guiding purposes in the control sleeve 4 which in turn is guided in the groove 19' of the valve block 18. As a result the roller 13 is always aligned in the running direction. The measuring piston 22 applies a force, which is proportional to the delivery pressure of the pump, to the roller 13 of the return element 3 towards the lever 14 of the hyperbola regulator.

Figure 7:
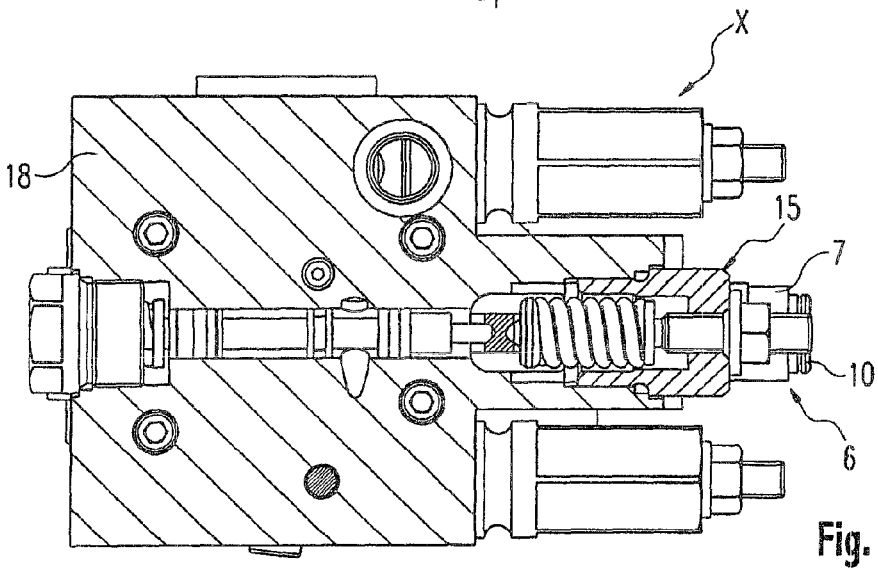
FIG. 7 shows a fourth section of the valve block of FIGS. 2 and 3.

A section of the regulating valve X along the line VII-VII is illustrated in FIG. 7, wherein the valve sleeve 7 and the valve screw 10 of the valve unit 6 can be seen beneath the regulating valve 15.

Figure 8:
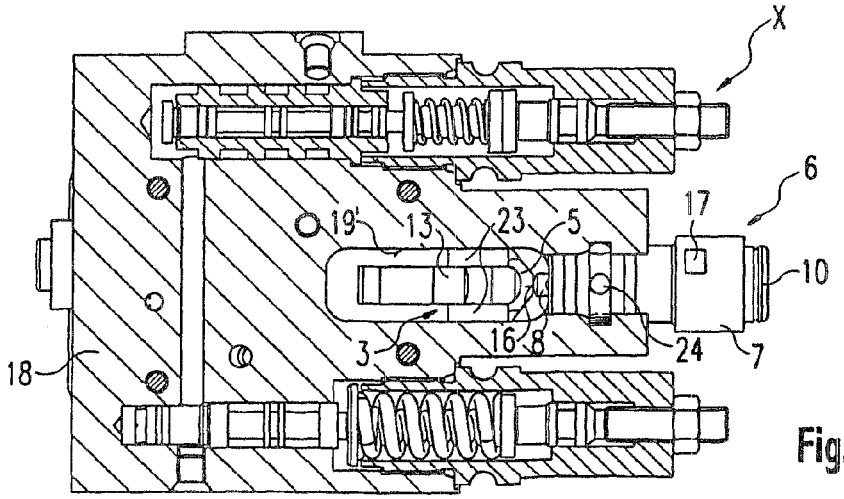
FIG. 8 shows a fifth section of the valve block of FIG. 1.

A further section through the valve block 18 is illustrated in FIG. 8. A recess 17 for engagement of the locking element 12 is provided on the valve sleeve 7. The end of the valve piston 8 remote from the locking screw 10 protrudes from the valve sleeve 7 and contacts the arm 5 of the control sleeve 4 at the contact point 16 between the arm 5 of the control sleeve 4 and valve piston 8 when the minimum delivery volume $V_{gmin}$ is reached.

Figure 9:
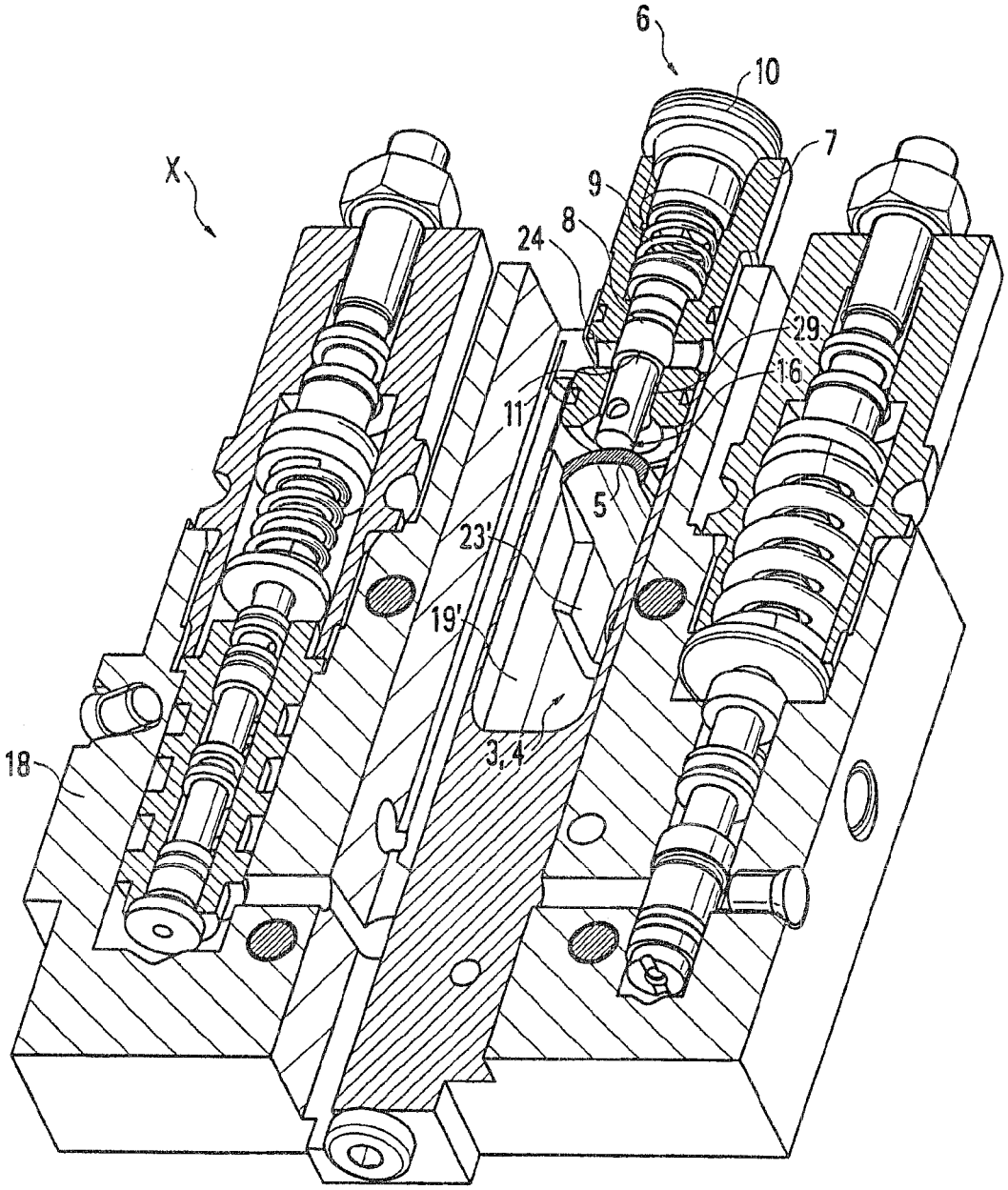
FIG. 9 shows a further perspective illustration of a section of the valve block of FIG. 1.

A perspective partial section through the valve block 18 is once again illustrated in FIG. 9. The valve piston 8, which can be displaced along the valve axis 20, forms a control edge 11 which is used to connect or separate the channel 24 and the chamber 29 for the flow of pressure medium depending upon the position of the valve piston 8 in the valve sleeve 7. The arm 5 and the guide sections 23' form a chamber for accommodating the head region of the measuring piston 22 with its guide surfaces 23. The groove 19' of the valve block 18 guides the control sleeve 4 along the axis 20 in that it prevents rotation of the control sleeve 4 about its longitudinal axis and a movement component of the control sleeve 4 perpendicular to the axis 20.

Figure 10:
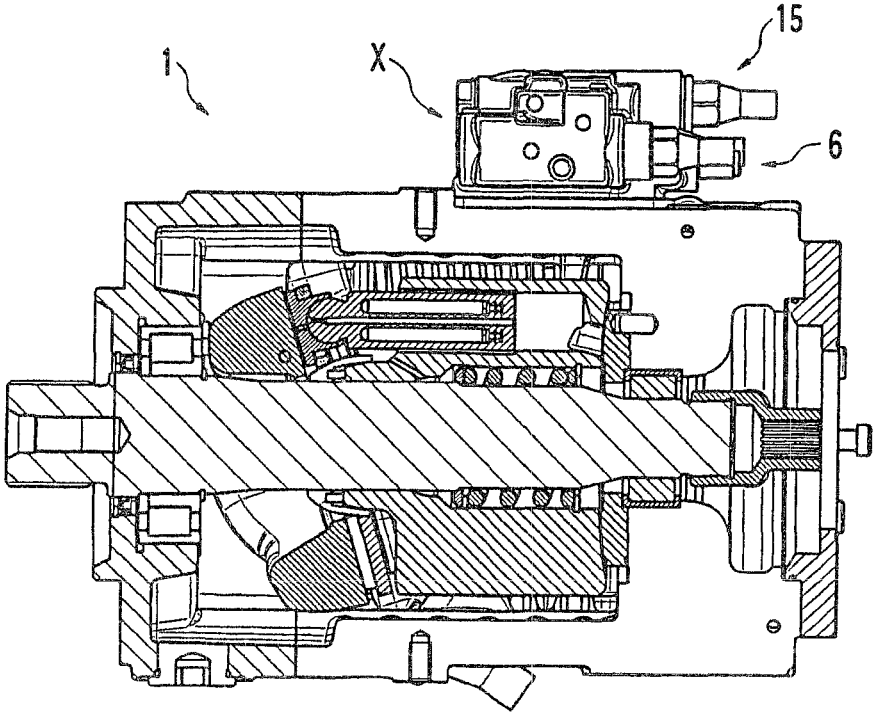
FIG. 10 shows a further section of the first exemplified embodiment of an axial piston machine in accordance with the invention.
Figure 11:
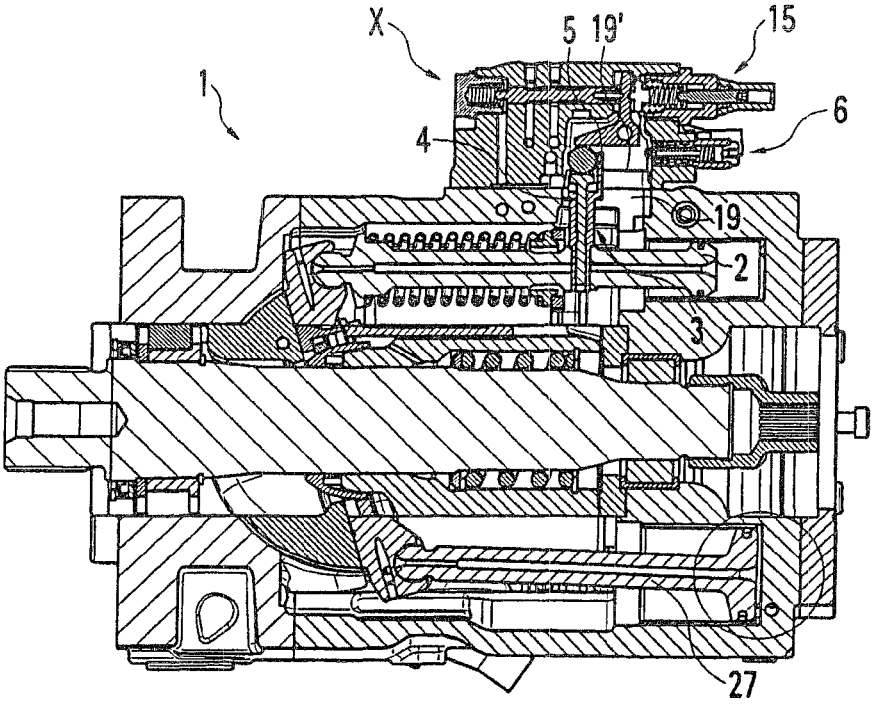
FIG. 11 shows a further side view of a section of the first exemplified embodiment of an axial piston machine in accordance with the invention.

FIGS. 10 and 11 show in each case a longitudinal section of a first exemplified embodiment of an axial piston machine 1 in accordance with the invention. For improved clarity, not all reference numbers have been provided in FIGS. 10 and 11. FIG. 10 shows a side view of the regulating valve X whereas FIG. 11 shows a section in a side view of the regulating valve X. The valve block 18 of the regulating valve X is attached to the axial piston machine 1 as in FIG. 1 such that the valve axis 20 and the pivot-out piston longitudinal axis are in parallel with each other in the same plane. The return element 3 is disposed on the pivot-out piston 2 and is guided in the groove 19' of the valve block 18 and the groove 19 of the housing of the axial piston machine 1. The return element 3 is approximately perpendicular to the pivot-out piston 2 and is in the same plane as the pivot-out piston longitudinal axis and the valve axis.

Figure 12:
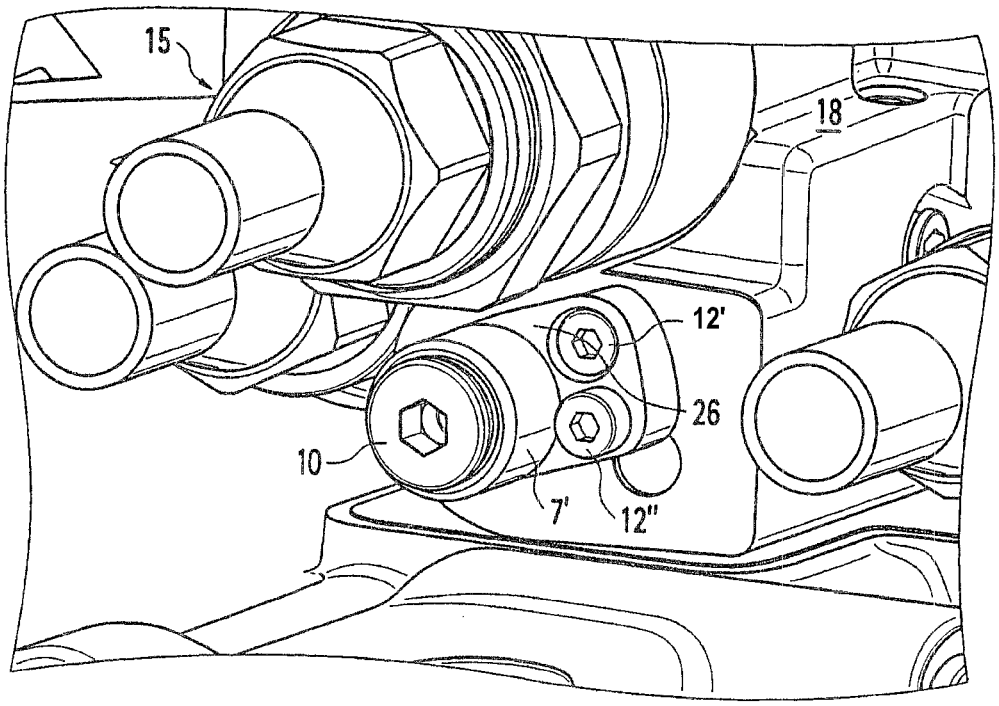
FIG. 12 shows a front view of the valve block of FIG. 1.

FIG. 12 illustrates a front view of the valve block 18. In contrast to the previous Figures with only one locking element 12, an element 26 is formed or fixed on a second valve sleeve 7' and extends radially outwards from the valve sleeve 7' and co-operates with a first and second locking element 12' and 12". The locking screw 10 is screwed into the valve sleeve 7'. The first locking element 12' is used to insert the valve sleeve 7' into the valve block 18 and constitutes an adjustable positive-locking arrangement against displacement of the valve sleeve 7' from the valve block 18. The second locking element 12" is used as a counterpart to the locking element 12' and prevents displacement of the valve sleeve 7' into the valve block 18 in an adjustable and positive-locking manner. The two locking elements 12' and 12" are designed as screws. The first locking element 12' is screwed into a thread incorporated in the valve block 18. The first locking element 12' penetrates the element 26. The lower side of the screw head forms a stop for the element 26. The second locking element 12", likewise formed as a barrier [sic], is screwed into a thread of the element 26. The end side of the screw then acts as a stop which is supported on the surface of the valve block 18.

Figure 13:
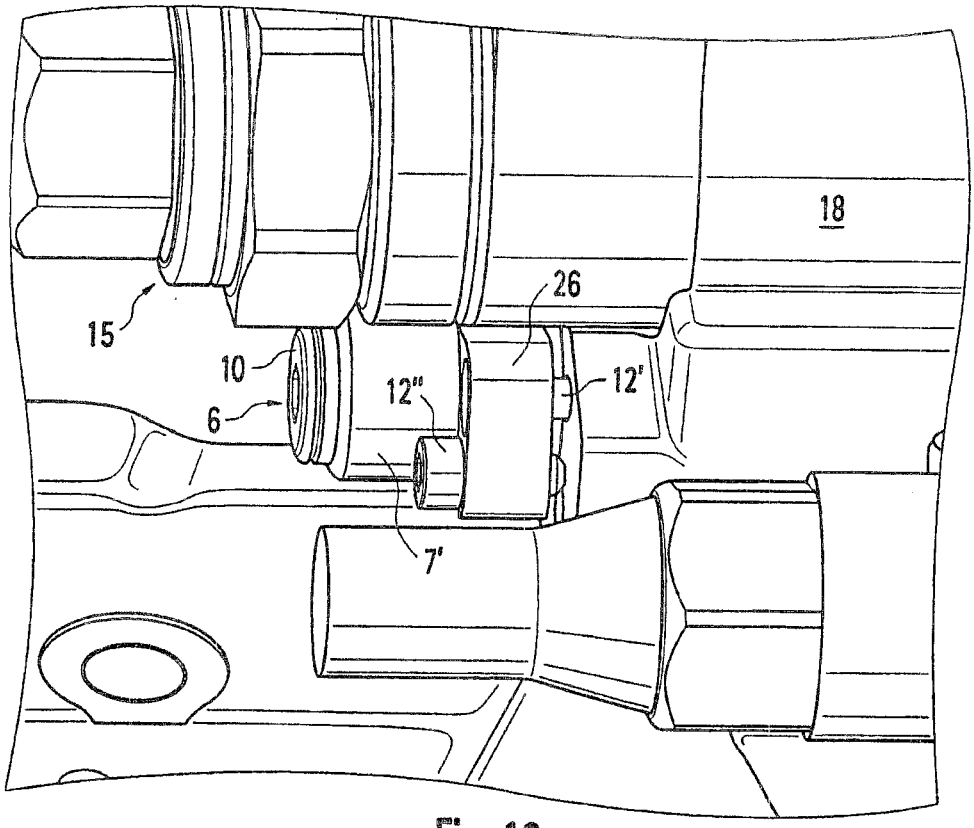
FIG. 13 shows a side view of the front part of the valve block of FIG. 1.

FIG. 13 likewise shows in a second perspective illustration the valve sleeve 7' slid into the valve block 18 and held in its position by means of the locking elements 12' and 12" and the element 26 formed thereon. In this case, the abutment of the element 26 against the screw head and the support of the end side of the screw on the housing can easily be seen.

The regulating valve X includes pressure, delivery flow and power regulators which are connected in series. The series connection consisting of the pressure, delivery flow and power regulators is connected at its first end to the tank volume and at its other second end to the control pressure chamber 28 of the pivot-in piston 27. The pressure, delivery flow and power regulators are formed in each case such that the control pressure chamber 28 of the pivot-in piston 27 is supplied with pressure or the respective other valves towards the tank are relieved. In the illustrated example, the power regulator is formed by the regulating valve 15. The second end of the series connection of the pressure, delivery flow and power regulators, which is connected to the control pressure chamber 28 of the pivot-in piston 27, comprises in parallel a connection to the valve unit 6, via which the pressure in the control pressure chamber 28 is supplied to the channel 24. As will be described in more detail hereinafter, a connection of the channel 26 towards the tank thus results in the fact that pressure cannot accumulate in the control pressure chamber 28 or relief towards the tank takes place.

During operation of the axial piston machine 1, the described valve unit 6 co-operates with the return element 3, which is disposed on the pivot-out piston 2 of the control device of the axial piston machine 1, such that a hydraulic stop for the limitation of the minimum delivery volume $V_{gmin}$ is achieved. The control pressure chamber 28 on the pivot-in piston 27 of the control device of the axial piston machine 1 is connected to the channel 24 of the valve unit 6. If it is pressurised by the supply of pressure medium via the regulating valve 15 such that as a result the pivot-out piston 2 and the return element 3 are displaced along the valve axis 20 towards the valve unit 6, then the arm 5 of the control sleeve 4 of the return element 3 approaches the valve piston 8 of the valve unit 6.

If the arm 5 reaches a position defined by the position of the valve unit 6 in the valve block 18, then the arm 5 of the control sleeve 4 and the valve piston 8 form a common contact point 16 and the valve piston 8 is displaced by the arm 5 of the control sleeve 4 along the valve axis 20 towards the locking screw 10 against the resistance of the compression spring 9. This actuation of the valve unit 6 causes the displacement of the valve piston 8 so far towards the locking screw 10 that a gap is produced between the valve sleeve 7 and the control edge 11 of the valve piston 8, which gap connects the channel 24 to the chamber, in which the contact point 16 is formed, via the control chamber 29 formed as an annular gap. In this manner, pressure medium can flow off from the control pressure chamber 28 of the pivot-in piston 27 via the channel 24 through the annular gap between the valve piston 8 and the valve sleeve 7 and via the chamber, in which the contact point 16 is formed, and the grooves 19 and 19' into the housing tank. The discharge of pressure medium from the control pressure chamber 28 of the pivot-in piston 27 causes a reduction in the control force of the control device towards the minimum delivery volume. Thus, further adjustment is hydrostatically prevented and hard mechanical stopping of components limiting the movement of the control device when the minimum delivery volume is reached is likewise prevented as a result.

Alternatively, limitation towards the maximum delivery volume is also feasible. By means of a valve disposed on the other side of the return element 3 and actuated via the return element 3, the control pressure chamber of the pivot-out piston 2 could be connected to the housing tank when a maximum delivery volume is reached.

As a further alternative, the control pressure chamber 28 of the pivot-in piston 27 could be connected to the operating pressure.

The invention is not limited to the illustrated exemplified embodiment. On the contrary, combinations of individual features of the exemplified embodiment are also advantageously possible.

The invention claimed is:

1. A hydrostatic machine comprising a control device for adjusting a displacement volume of the hydrostatic machine, wherein the control device comprises a return element for controlling a regulating valve in dependence upon a position of the control device, wherein in addition to the regulating valve, a valve unit for adjusting a control pressure of the control device is provided, wherein a pressure medium flows via the regulating valve to a control pressure chamber of the control device, thereby charging the control pressure chamber, and the valve unit is mechanically actuated by the return element to counteract a further adjustment of the control device in a same movement direction by discharging the pressure medium from the control pressure chamber when a predetermined position of the control device is reached, wherein the return element comprises a control sleeve, wherein an arm is disposed on one side of the control sleeve of the return element and extends in a longitudinal direction of the control sleeve, wherein the valve unit comprises a displaceable valve piston, and wherein, to actuate the valve unit, the displaceable valve piston is mechanically displaced by an application of force by the arm of the control sleeve of the return element.

2. The hydrostatic machine as claimed in claim 1, wherein the control device comprises a first control piston for increasing the displacement volume of the hydrostatic machine and the first control piston is coupled to the return element.

3. The hydrostatic machine as claimed in claim 2, wherein the return element is disposed on the first control piston such that the return element performs a movement in a movement plane having a directional component towards a pivot-out piston longitudinal axis.

4. The hydrostatic machine as claimed in claim 3, wherein the valve unit has a longitudinal axis in parallel with the movement plane of the return element.

5. The hydrostatic machine as claimed in, claim 1, wherein the return element is guided in a groove of a pot-shaped housing of the hydrostatic machine.

6. The hydrostatic machine as claimed in claim 1, wherein the arm of the control sleeve of the return element forms a common mechanical contact point with the valve unit for an application of force.

7. The hydrostatic machine as claimed in claim 1, wherein the valve unit comprises a valve sleeve which is locked in a valve block to be adjustable relative to the valve block in terms of the position of the valve sleeve in the longitudinal direction to adjust an actuating position.

8. The hydrostatic machine as claimed in claim 7, wherein the valve sleeve of the valve unit is locked in a positive-locking manner by means of at least one locking element.

9. The hydrostatic machine as claimed in claim 8, wherein for the positive-locking of the valve sleeve of the valve unit in the valve block, the at least one locking element engages into a recess formed on the valve sleeve.

10. The hydrostatic machine as claimed in claim 8, wherein for the positive-locking of the valve sleeve of the valve unit, a stop element formed on the valve sleeve co-operates at least with the at least one locking element attached to a housing of the hydrostatic machine to be variable in the longitudinal direction of the valve unit.

11. The hydrostatic machine as claimed in claim 10, wherein the valve unit is disposed to be displaceable in a housing by means of the positive-locking arrangement.

12. The hydrostatic machine as claimed in claim 11, wherein a displacement volume of the hydrostatic machine is adjustable via the positive-locking arrangement, wherein hydraulic limitation of the adjustment of the displacement volume of the hydrostatic machine is effective.

13. The hydrostatic machine as claimed in claim 1, wherein the valve piston of the valve unit forms, together with a valve sleeve, a control chamber which is open towards a housing tank of the hydrostatic machine.

14. The hydrostatic machine as claimed in claim 1, wherein the hydrostatic machine is an axial piston machine.

15. A hydrostatic machine comprising a control device for adjusting a displacement volume of the hydrostatic machine, wherein the control device comprises a return element for controlling a regulating valve in dependence upon a position of the control device, wherein in addition to the regulating valve, a valve unit for adjusting a control pressure of the control device is provided, wherein a pressure medium flows via the regulating valve to a control pressure chamber of the control device, thereby charging the control pressure chamber, and the valve unit is mechanically actuated by the return element to counteract a further adjustment of the control device in a same movement direction by discharging the pressure medium from the control pressure chamber when a predetermined position of the control device is reached, wherein the valve unit comprises a displaceable valve piston and a valve sleeve, and wherein the displaceable valve piston of the valve unit and the valve sleeve form a control chamber that is open towards a housing tank of the hydrostatic machine.

16. The hydrostatic machine as claimed in claim 15, wherein the control device comprises a first control piston for increasing the displacement volume of the hydrostatic machine and the first control piston is coupled to the return element.

17. The hydrostatic machine as claimed in claim 16, wherein the return element is disposed on the first control piston such that the return element performs a movement in a movement plane having a directional component towards a pivot-out piston longitudinal axis.

18. The hydrostatic machine as claimed in claim 17, wherein the valve unit has a longitudinal axis in parallel with the movement plane of the return element.

19. The hydrostatic machine as claimed in, claim 15, wherein the return element is guided in a groove of a pot-shaped housing of the hydrostatic machine.

20. The hydrostatic machine as claimed in claim 15, wherein the return element comprises a control sleeve.

21. The hydrostatic machine as claimed in claim 20, wherein an arm is disposed on one side of the control sleeve of the return element and extends in a longitudinal direction of the control sleeve.

22. The hydrostatic machine as claimed in claim 21, wherein the arm of the control sleeve of the return element forms a common mechanical contact point with the valve unit for an application of force.

23. The hydrostatic machine as claimed in claim 15, wherein the valve sleeve is locked in a valve block to be adjustable relative to the valve block in terms of the position of the valve sleeve in the longitudinal direction to adjust an actuating position.

24. The hydrostatic machine as claimed in claim 23, wherein the valve sleeve of the valve unit is locked in a positive-locking manner by means of at least one locking element.

25. The hydrostatic machine as claimed in claim 24, wherein for the positive-locking of the valve sleeve of the valve unit in the valve block, the at least one locking element engages into a recess formed on the valve sleeve.

26. The hydrostatic machine as claimed in claim 24, wherein for the positive-locking of the valve sleeve of the valve unit, a stop element formed on the valve sleeve co-operates at least with the at least one locking element attached to a housing of the hydrostatic machine to be variable in the longitudinal direction of the valve unit.

27. The hydrostatic machine as claimed in claim 26, wherein the valve unit is disposed to be displaceable in a housing by means of the positive-locking arrangement.

28. The hydrostatic machine as claimed in claim 27, wherein a displacement volume of the hydrostatic machine is adjustable via the positive-locking arrangement, wherein hydraulic limitation of the adjustment of the displacement volume of the hydrostatic machine is effective.

29. The hydrostatic machine as claimed in claim 21, wherein to actuate the valve unit, the displaceable valve piston is mechanically displaced by an application of force by the arm of the control sleeve of the return element.

30. The hydrostatic machine as claimed in claim 15, wherein the hydrostatic machine is an axial piston machine.

* * * * *